US009090061B2

(12) United States Patent
Nakamura

(10) Patent No.: US 9,090,061 B2
(45) Date of Patent: Jul. 28, 2015

(54) PIEZOELECTRIC ELEMENT DRIVE METHOD AND LIQUID EJECTING DEVICE

(71) Applicant: CANON KABUSHIKI KAISHA, Tokyo (JP)

(72) Inventor: Yohei Nakamura, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/146,848

(22) Filed: Jan. 3, 2014

(65) Prior Publication Data

US 2014/0192105 A1 Jul. 10, 2014

(30) Foreign Application Priority Data

Jan. 10, 2013 (JP) ..... 2013-002410

(51) Int. Cl.
*B41J 29/38* (2006.01)
*B41J 2/045* (2006.01)
*B41J 2/14* (2006.01)

(52) U.S. Cl.
CPC ..... *B41J 2/04588* (2013.01); *B41J 2/04541* (2013.01); *B41J 2/04581* (2013.01); *B41J 2/14209* (2013.01)

(58) Field of Classification Search
CPC ..... B41J 2/04541; B41J 2/04581; B41J 2/04588; B41J 2/14209; B41J 2/14201
USPC ..... 347/10, 12, 14, 19
See application file for complete search history.

(56) References Cited

U.S. PATENT DOCUMENTS

2012/0287186 A1* 11/2012 Tanaka et al. ..... 347/10

FOREIGN PATENT DOCUMENTS

JP 2006-321200 A 11/2006

* cited by examiner

*Primary Examiner* — Jannelle M Lebron
(74) *Attorney, Agent, or Firm* — Fitzpatrick, Cella, Harper & Scinto

(57) ABSTRACT

Liquid is forced to be ejected from a liquid chamber as a drive voltage is applied to the piezoelectric element that forms part or all of the walls of the liquid chamber by means of a drive circuit to deform the piezoelectric element. The drive circuit applies a pre-drive voltage to the piezoelectric element prior to the application of the drive voltage waveform for driving the piezoelectric element. The pre-drive voltage is higher than the highest voltage level of the drive voltage waveform.

12 Claims, 10 Drawing Sheets

PIEZOELECTRIC ELEMENT DRIVE METHOD AND LIQUID EJECTING DEVICE

BACKGROUND OF THE INVENTION

1. Field of the Invention

The present invention relates to a piezoelectric element drive method and also to a liquid ejecting device for ejecting liquid such as ink.

2. Description of the Related Art

Liquid ejecting devices for ejecting liquid such as ink to record an image on a recording medium generally have a liquid ejection head for ejecting liquid that is mounted thereon.

A mechanism that utilizes a pressure chamber whose capacity can be reduced when a piezoelectric element that operates as part or all of the walls thereof is deformed is known as mechanism for ejecting liquid from a liquid ejection head. With such a mechanism, the piezoelectric element is deformed by applying a voltage to the element and making the pressure chamber contract as a result of the deformation of the piezoelectric element to consequently eject liquid from the pressure chamber by way of the ejection port formed at an end of the pressure chamber.

So-called shear mode type liquid ejection heads having pressure chambers, each of which has one or two of the inner walls that are formed by a piezoelectric element, is known as a type of liquid ejection head having a mechanism for ejecting liquid by means of piezoelectric elements.

A liquid ejection head of the shear mode type contracts the pressure chambers hereof by applying pressure to the piezoelectric elements thereof and hence not by elongation deformation and contraction deformation but by shear deformation.

Liquid ejecting devices for industrial applications are required to use highly viscous liquid. Then, such devices are required to produce large liquid ejecting power in order to eject highly viscous liquid. To meet the requirement, so-called Gould type liquid ejection heads having pressure chambers formed by using tubular piezoelectric members representing a circular or rectangular cross section have been proposed.

Each of the pressure chambers of a Gould type liquid ejection head is expanded or contracted by subjecting the piezoelectric member or members thereof to elongation deformation and contraction deformation in outward and inward directions (radial directions) relative to the center of the pressure chamber. Thus, in a Gould type liquid ejection head, all the wall surfaces of the pressure chambers thereof are deformed and the deformation of the wall surfaces serves to generate ejection force. Thus, a Gould type liquid ejection head can provide large ejection force if compared with a share mode type liquid ejection head.

The displacement amount of a piezoelectric element varies as a function of the bias voltage applied to it if the drive voltage waveform applied thereto remains same. For example, when a 10 Vp-p rectangular waveform is applied, the displacement amount varies between an instance where a rectangular wave from 0 V to 10 V (bias voltage=0V) is applied and an instance where a rectangular wave from 10 V to 20 V (bias voltage=10 V) is applied. Besides, liquid ejection heads manufactured with exactly same specifications can represent different displacement characteristics of piezoelectric elements thereof relative to the bias voltage applied to them. In other words, the liquid ejection characteristics can vary from a liquid ejection head to another if a same bias voltage is used.

In view of this problem, Japanese Patent Application Laid-Open No. 2006-321200 discloses a technique of selecting a bias voltage that maximizes the displacement amount of a piezoelectric element by changing the bias voltage being applied to the piezoelectric element and thereby detecting the displacement characteristics of the piezoelectric element relative to the bias voltage.

The above-cited technique can obtain large ejection force because a bias voltage that maximizes the displacement amount of a piezoelectric element can be selected and applied to the piezoelectric element.

The use of a piezoelectric element that is made of a material referred to as a soft material and can produce a large displacement amount has been and is being studied in order to obtain large ejection force. In comparison with hard materials, however, soft materials generally represent a record of large displacement amounts (a large hysteresis curve) when the voltage being applied to the material is changed. Additionally, soft materials represents a low coercive electric field if compared with hard materials. Thus, when a piezoelectric element referred to as soft material is employed, degradation of polarization characteristics can arise to change the displacement characteristics of the piezoelectric element when a negative voltage is applied thereto.

With the technique disclosed in Japanese Patent Application Laid-Open Publication No. 2006-321200, if a bias voltage is selected so as to maximize the displacement amount of a piezoelectric element, the displacement amount of the piezoelectric element can be changed to consequently give rise to unstable ejection force because of degradation of the hysteresis curve and that of polarization characteristics. This problem becomes remarkable when a soft material having the above-described characteristics is employed.

SUMMARY OF THE INVENTION

In an aspect of the present invention, the above problem is dissolved by providing a piezoelectric element drive method of applying a voltage to a piezoelectric element by means of a drive circuit to deform the piezoelectric element, the method including: a step of applying a drive voltage waveform to the piezoelectric element by means of the drive circuit to drive the piezoelectric element; and a step of applying a pre-drive voltage to the piezoelectric element prior to applying the drive voltage waveform; the pre-drive voltage being higher than the highest voltage of the drive voltage waveform.

In another aspect of the present invention, there is provided a liquid ejecting device for ejecting ink from a liquid chamber to record an image by applying the piezoelectric element forming the wall of the liquid chamber and thereby deforming the piezoelectric element, the device including: a drive circuit that applies a drive voltage waveform to the piezoelectric element and also applies a pre-drive voltage to the piezoelectric element prior to applying the drive voltage waveform; the pre-drive voltage being higher than the highest voltage of the drive voltage waveform.

Further features of the present invention will become apparent from the following description of exemplary embodiments with reference to the attached drawings.

DESCRIPTION OF THE EMBODIMENTS

Now, embodiments of the present invention will be described below by referring to the accompanying drawings.

First Embodiment

Figure 1:
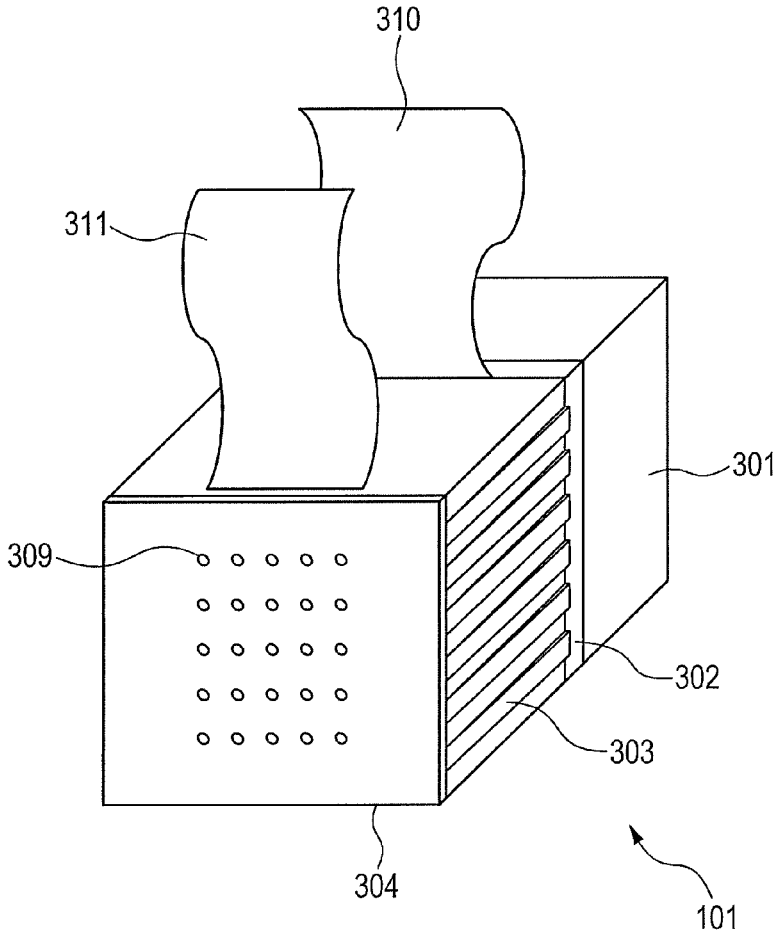
FIG. 1 is a schematic perspective view of a liquid ejection head unit to be mounted in an embodiment of liquid ejecting device according to the present invention.
Figure 2:
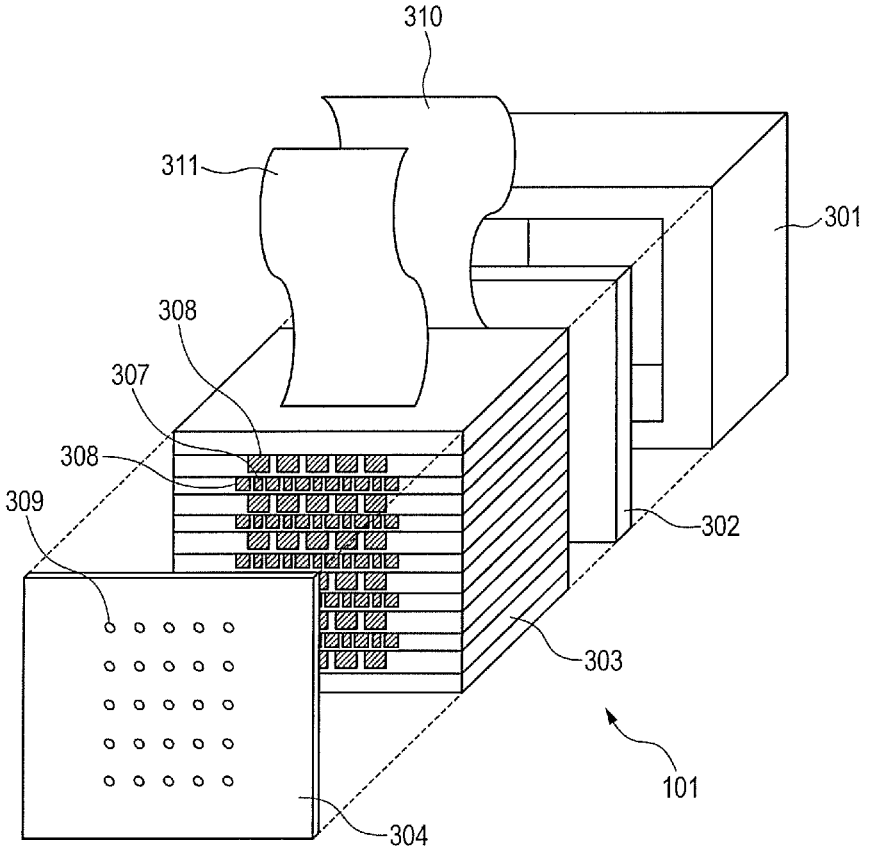
FIG. 2 is an exploded schematic perspective view of the liquid ejection head unit illustrated in FIG. 1.

FIG. 1 is a schematic perspective view of a liquid ejection head unit 101 to be mounted in a liquid ejecting device for ejecting liquid such as ink according to the present invention. FIG. 2 is an exploded schematic perspective view of the liquid ejection head unit 101 illustrated in FIG. 1.

Referring to FIGS. 1 and 2, the liquid ejection head unit 101 includes an orifice plate 304, a liquid ejection head 303, a rear diaphragm plate 302 and a common liquid chamber 301, which are stacked one on the other in the above mentioned order and bonded together to formed the unit.

As illustrated in FIG. 2, a plurality of individual liquid chambers (pressure chambers) 307 and a plurality of air chambers (spaces) 308 that are arranged around the individual liquid chambers 307 and separated from the individual liquid chambers 307 are provided in the liquid ejection head 303.

First and second flexible printed circuits (FPCs) 310, 311 are drawn out from an end surface of the liquid ejection head 303 so as to operate as wirings that extend from the liquid ejection head 303 to the outside.

The common liquid chamber 301 is held in communication with the individual liquid chambers 307 of the liquid ejection head 303 by way of the rear diaphragm plate 302.

The orifice plate 304 is provided with a plurality of ejection ports 309 that are arranged at crossings of a lattice so as to correspond to the respective individual liquid chambers 307 for the purpose of ejecting droplets out of the liquid that is contained and pressurized in the individual liquid chambers 307.

Figure 3:
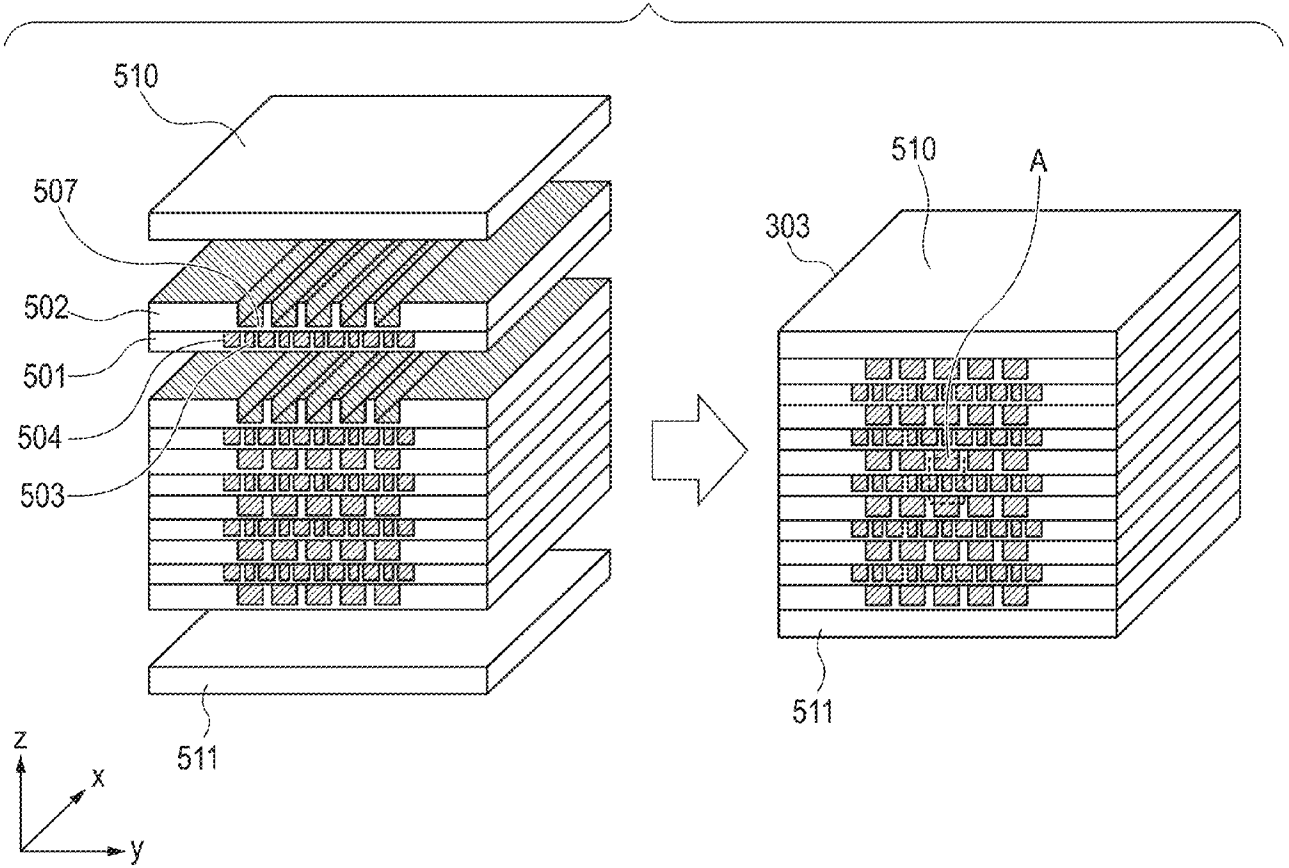
FIG. 3 is an exploded schematic perspective view and a schematic perspective view of a liquid ejection head to be used for forming the liquid ejection head unit illustrated in FIG. 1.

FIG. 3 is an exploded schematic perspective view and a schematic perspective view of the liquid ejection head 303. Note that the electrodes, which will be described hereinafter, are omitted from FIG. 3. As illustrated in FIG. 3, a plane that is parallel to the piezoelectric plates of the liquid ejection head 303 is referred to as x-y plane and the direction perpendicular to the piezoelectric plates is referred to as z-direction in the following description.

The liquid ejection head 303 has a multilayer structure formed by alternately laying first piezoelectric plates 501 and second piezoelectric plates 502 in the z-direction.

A plurality of first grooves 503 and a plurality of second grooves are formed alternately on one of the opposite surfaces of each of the first piezoelectric plates 501.

On the other hand, a plurality of third grooves 507 is formed on one of the opposite surfaces of each of the second piezoelectric plates 502. All the first grooves 503, the second grooves 504 and the third grooves 507 extend in the x-direction.

As illustrated in FIG. 3, the first piezoelectric plates 501 and the second piezoelectric plates 502 are alternately and sequentially laid one on the other in such a manner that a surface having grooves thereon (grooves-carrying surface) contacts a surface where no grooves are formed (no grooves-carrying surface). As a result, long and narrow individual liquid chambers 307 are produced by the first grooves 503 and the second piezoelectric plates 502.

Similarly, air chambers 308 that extend in parallel with the individual liquid chambers 307 are produced by the second grooves 504 and the second piezoelectric plates 502 and also by the third grooves 507 and the first piezoelectric plates 501. Each of the air chambers 308 is arranged so as to be sandwiched between two of the individual liquid chambers 307 that are arranged at crossings of a lattice in a y-z plane.

The liquid ejection head 303 is further provided with a third plate (substrate) 510 and a fourth plate (substrate) 511 that are arranged at the opposite ends of the multilayer structure (as viewed in the z-direction) so as to sandwich the first piezoelectric plates 501 and the second piezoelectric plates 502 of the multilayer structure between them. The third substrate 510 and the fourth substrate 511 have a role of correcting the warps (if any) of the plates of the multilayer structure.

As illustrated in FIG. 3, the inner walls of each of the individual liquid chambers 307 are linked to the inner walls of the neighboring ones of the air chambers 308 by way of the wall parts disposed in-between. The rigidity of the surroundings of the individual liquid chambers 307 can be enhanced with this arrangement.

Figure 4A:
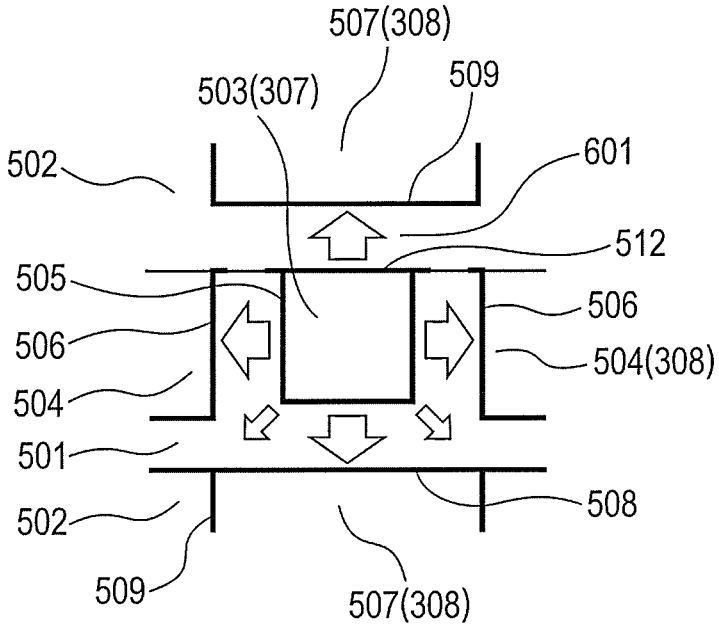
FIGS. 4A and 4B are enlarged schematic plan views of region A illustrated in FIG. 3 and its vicinity.
Figure 4B:
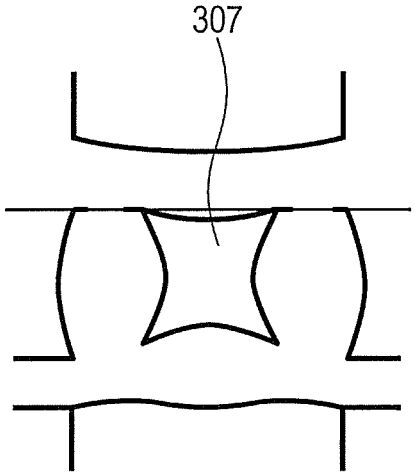

Now, the operation of driving the liquid ejection head 303 will be described below by referring to FIGS. 4A and 4B. FIGS. 4A and 4B are enlarged schematic plan views of region A illustrated in FIG. 3 and its vicinity as viewed in the direction of liquid ejection of the liquid ejection head 303. Note that FIG. 4A is a view in a state where the liquid ejection head 303 is not driven to operate, whereas FIG. 4B is a view in a state where the liquid ejection head 303 is driven to operate.

The individual liquid chambers 307 that are produced by the first grooves and the second piezoelectric plates 502 are arranged at crossings of a lattice in a y-z plane as illustrated in FIG. 3. The air chambers 308 that are produced by the second grooves 504 and the second piezoelectric plates 502 and also by the third grooves 507 and the first piezoelectric plates 501 are arranged at positions that are separated from the individual liquid chambers 307.

As illustrated in FIG. 4A, the partition walls that separate the individual liquid chambers 307 and the air chambers 308 are polarized in directions of polarization 601 that face radially outward as viewed from the opening of each of the individual liquid chambers 308.

Electrodes (electrodes SIG) 505 and 512, which are omitted from FIG. 3, are arranged on the inner walls of each of the individual liquid chambers 307. On the other hand, electrodes (electrodes GND) 506, 508 and 509 are formed on the inner walls of each of the air chambers 308.

As a drive voltage is applied between the electrodes SIG and the electrodes GND, making the electrodes (electrodes SIG) 505 and 512 and the electrodes (electrodes GND) 506, 508 and 109 respectively represent a positive potential and the GND potential, the partition walls that defines the individual liquid chambers 307 are deformed to contract the individual liquid chambers 307 as illustrated in FIG. 4B. As the individual liquid chambers 307 are deformed in this manner, the pressure of the liquid filled in the individual liquid chambers 307 is raised to eject liquid from the ejection ports.

On the other hand, as a drive voltage is applied between the electrodes SIG and the electrodes GND, making the electrodes (electrodes SIG) 505 and 512 and the electrodes (electrodes GND) 506, 508 AND 109 respectively represent the GND potential and a positive potential, the partition walls that defines the individual liquid chambers 307 are deformed to expand the individual liquid chambers 307 (although not-illustrated in the drawings).

Figure 5:
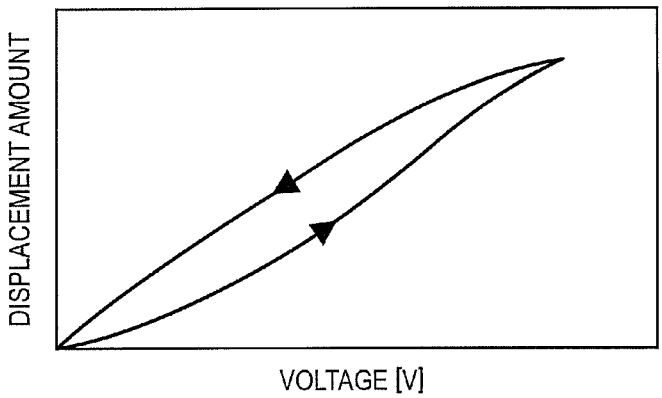
FIG. 5 is a graph illustrating the hysteresis characteristics of a piezoelectric element.

FIG. 5 is a graph illustrating the relationship between the voltage applied to a piezoelectric element and the displacement amount of the piezoelectric element produced by the applied voltage.

As seen from FIG. 5, the displacement amount of a piezoelectric element generally represents a hysteresis loop. In other words, the record of displacement amount of a piezoelectric element that is observed when the voltage applied to the element rises differs from the record of displacement amount that is observed when the voltage applied to the element falls.

Besides, the displacement amount of a piezoelectric element can change over a long period of time. This is a phenomenon referred to as creep phenomenon. A creep phenomenon occurs when the state of polarization of a piezoelectric element changes. As the voltage being applied to a piezoelectric element is changed stepwise, the displacement amount of the piezoelectric element rapidly changes to a certain extent in a short period of time but thereafter the displacement amount keeps on changing only slowly over a long period of time toward the largest displacement amount as indicated by a broken line in FIG. 6.

Figure 7A:
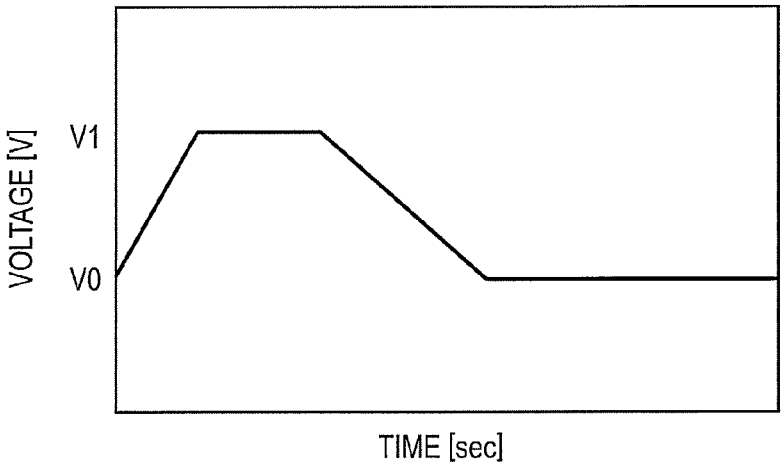
FIG. 7A is an exemplar waveform of the voltage to be applied to a piezoelectric element.

FIG. 7A is an exemplar waveform of the voltage to be applied to a piezoelectric element (drive waveform).

The drive waveform illustrated in FIG. 7A tells that liquid is ejected as the electric potential of the electrodes is raised to a positive voltage (voltage V1) level relative to a bias voltage (voltage V0) so as to force the individual liquid chambers 307 to contract and thereafter the electric potential is made to return to the bias voltage (voltage V0). This drive waveform is a drive waveform of so-called 'press shooting'.

Figure 6:
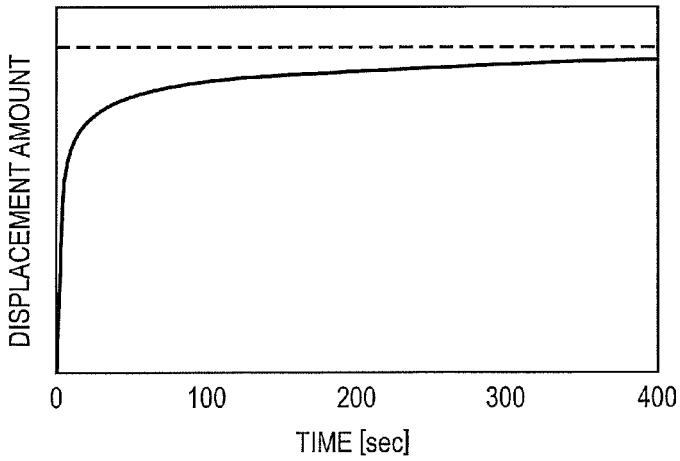
FIG. 6 is a graph illustrating a creep phenomenon of a piezoelectric element.

Desired liquid droplets can be obtained for ejection by controlling the displacement amount of the piezoelectric elements by means of the potential difference between voltage V1 and voltage V0. However, in reality, a same displacement amount cannot be obtained when a drive voltage of a same waveform is applied to it due to hysteresis as illustrated in FIG. 5 and the creep phenomenon as illustrated in FIG. 6.

Figure 7B:
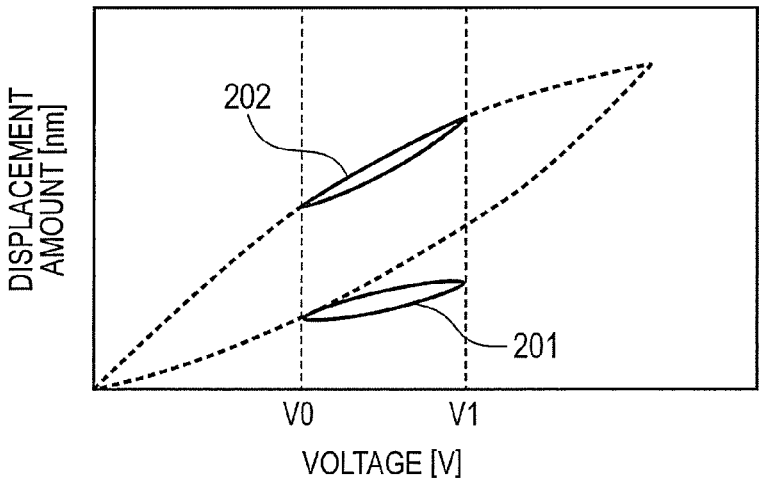
FIG. 7B is a graph illustrating the relationship of the voltage-displacement characteristics of a piezoelectric element that can be obtained according to the present invention.

FIG. 7B is a graph illustrating the displacement amount of a piezoelectric element when a drive voltage having a waveform as illustrated in FIG. 7A is applied.

Referring to FIG. 7B, in a period of time during which the voltage that is being applied to the piezoelectric element is rising, the displacement 201 of the piezoelectric element does not follow the corresponding hysteresis curve and the displacement amount becomes relatively small. It may be safe to assume that this is because the displacement amount of the piezoelectric element cannot get to the highest level for the reason that the duration of time of application of voltage V1 is short and hence the voltage being applied to the piezoelectric element returns to the bias voltage (V0) level before the state of polarization of the piezoelectric element changes due to a creep phenomenon.

On the other hand, in a period of time during which the voltage that is being applied to the piezoelectric element is falling after the voltage has got to the highest level, the state of polarization of the piezoelectric element is such that the piezoelectric element can easily be displaced because a high electric field has once been applied to the piezoelectric element. Therefore, the displacement 202 of the piezoelectric element represents a minor loop that follows the corresponding hysteresis curve. Thus, the displacement amount of the piezoelectric element that is observed when the voltage being applied to the piezoelectric element is falling after it has once got to the highest level than the displacement amount of the piezoelectric element that is observed when the voltage being applied to the piezoelectric element is rising.

Thus, in instances such as an instance where the piezoelectric element has been left without operation for a long period of time so that the polarization of the piezoelectric element has been degraded due to changes thereof with time, the hysteresis curve itself may have been changed. Then, as a result, the displacement amount of the piezoelectric element will become easily changeable. Consequently, the droplet ejection characteristics of the liquid ejection head including such piezoelectric elements will be changed to make it difficult to record a desired image.

Figure 8:
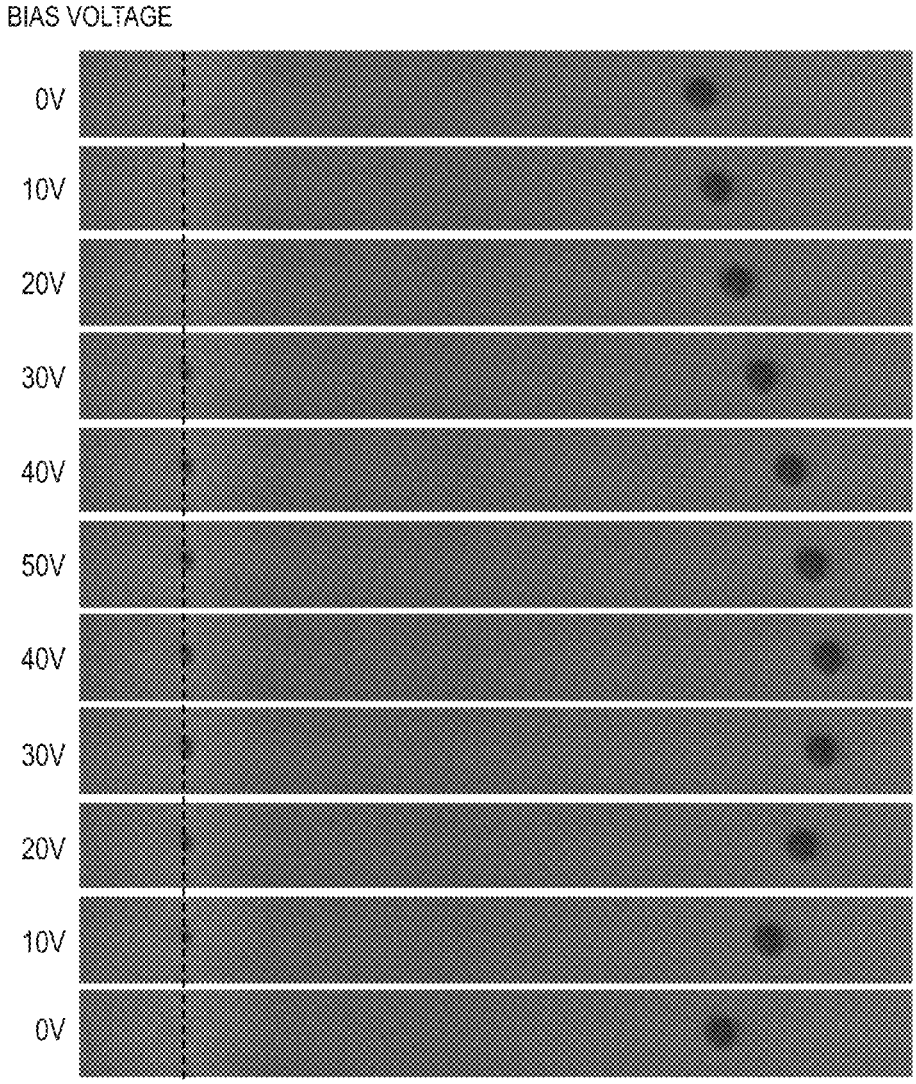
FIG. 8 is a schematic illustration of the behaviors of liquid droplets ejected from a liquid ejection head that are obtained when the bias voltage that is being applied to the liquid ejection head is made to vary.

FIG. 8 is a schematic illustration of the behaviors of liquid droplets ejected from a liquid ejection head that are obtained when of the bias voltage that is being applied to the liquid ejection head is made to vary.

FIG. 8 illustrates images of ejected liquid droplets that are obtained when a voltage that is equal to the voltage difference (20 V) between voltage V1 and voltage V0 illustrated in FIG. 7A is applied to a piezoelectric element so as to press shoot liquid droplets from left to right. In FIG. 8, the images of ejected liquid droplets that are obtained when the bias voltage (voltage V0) is raised from 0 V to 50 V and then made to fall back to 0 V again by a unit of 10 V at a time are sequentially arranged from above.

As seen from FIG. 8, the liquid droplet hitting position is shifted rightward as the bias voltage is raised. This fact tells that, as the bias voltage is raised, the displacement amount of the piezoelectric element is increased (because the liquid droplet ejecting force of the liquid ejection head rises) to by turn raise the liquid droplet ejecting speed of the liquid ejection head.

As the bias voltage is raised to 50 V and then made to fall back, it will be found that the liquid droplet hitting position is shifted rightward most when the bias voltage falls to 40 V and thereafter the liquid droplet hitting position is gradually shifted back to the left side. Thus, it will be seen that the displacement amount of the piezoelectric element is maximized (to raise the liquid droplet ejecting force of the liquid ejection head) when the bias voltage is raised to 50V and then made to fall to 40 V and that, thereafter, the displacement amount of the piezoelectric element is reduced as the bias voltage is made to fall further.

Therefore, a large displacement amount can be obtained for the piezoelectric element when the bias voltage is made to fall rather than when the bias voltage is made to rise. Additionally, the liquid droplet hitting position is shifted only to a small extent and hence the ejection characteristics are not changed to a large extent to consequently improve the robustness of the shift amount of the piezoelectric element per unit fall of the bias voltage when the bias voltage is 40 V and 30 V.

As described above, the state of polarization of a piezoelectric element can be recovered from degradation due to changes with time by applying a high bias voltage. Thereafter, a large and stable displacement amount can be obtained by making the bias voltage fall.

Figure 9:
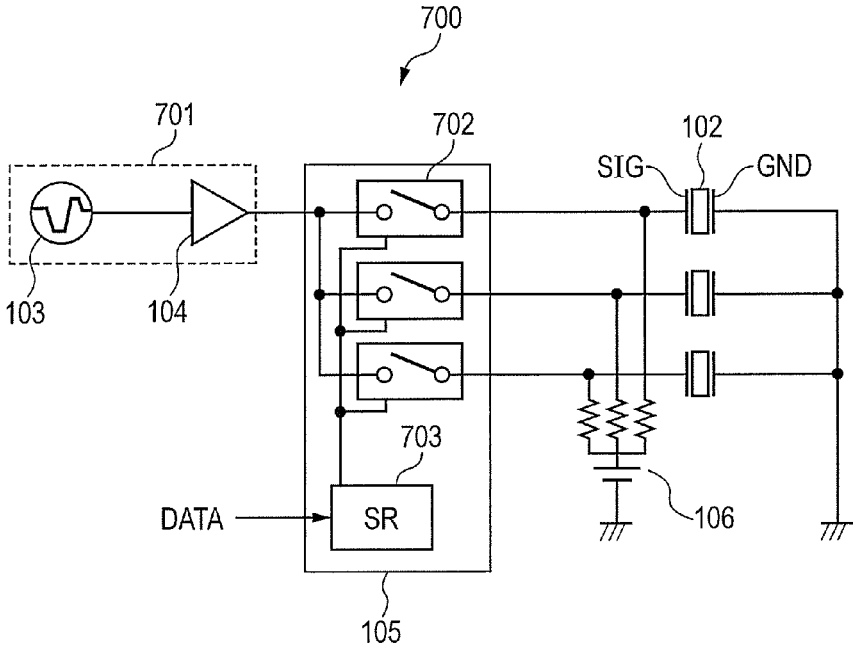
FIG. 9 is a schematic circuit diagram of the drive circuit according to the first embodiment of the present invention, representing the configuration thereof.

FIG. 9 is a schematic circuit diagram of the drive circuit of the first embodiment of the present invention, representing the configuration thereof.

Drive circuit 700 controls the operation of driving a plurality of piezoelectric elements 102 arranged in correspondence to a plurality of ejection ports 309. More specifically, the drive circuit 700 selectively applies a drive voltage to the plurality of piezoelectric elements 102 that are provided.

Each of the plurality of piezoelectric elements 102 has electrode SIG (first electrode) formed on the inner wall of an individual liquid chamber 307 and electrode GND (second electrode) that is a common electrode and the electrode SIG and the electrode GND are connected to the drive circuit 700 respectively by way of FPCs 310 and 311.

The drive circuit 700 includes a waveform generating section 103, an amp 104, a switch circuit 105 and pull-up resistors 105.

The waveform generating section 103 outputs a drive voltage waveform to the amp 104.

The amp 104 outputs a voltage obtained by amplifying the drive voltage waveform output from the waveform generating section 103. The waveform generating section 103 and the amp 104 constitute a first power supply section 701.

The switch circuit 105 has a plurality of switches 701 arranged so as to respectively correspond to the plurality of piezoelectric elements 102 and a shift register (SR) 703. It selectively outputs the voltage amplified by the amp 104 to the piezoelectric elements 102 according to the data that indicates the one or more than one piezoelectric elements to be driven.

The plurality of switches 702 are connected respectively to the electrodes SIG of the corresponding piezoelectric elements 102.

The shift register 703 turns ON or OFF each of the switches 702 according to the data indicated by the one or more than one piezoelectric elements to be driven and selectively applies the voltage output from the amp 104 to the piezoelectric elements 102.

The electrodes GND are grounded. A pull-up resistor 106 is provided in front of the electrode SIG of each of the piezoelectric elements 102 so that an offset voltage is applied to the piezoelectric elements 102 regardless if some of the switches 702 that correspond to so many piezoelectric elements 102 are OFF.

Figure 10:
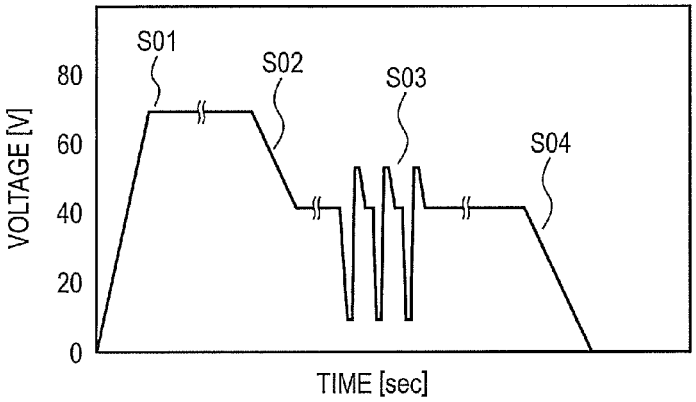
FIG. 10 is an exemplar waveform of the voltage to be applied to piezoelectric elements by a drive circuit.

FIG. 10 illustrates an exemplar waveform of the voltage that can be applied to the piezoelectric elements from the first power supply section 701 (the waveform generating section 103 and the amp 104).

First, the switch circuit 105 turns ON the switches 702 that correspond to the respective piezoelectric elements so as to apply the voltage to all the piezoelectric elements 102.

Then, the first power supply section 702 raises the voltage to the level of a pre-drive voltage (e.g., 70 V) that is higher than the highest voltage level of the drive voltage waveform (e.g., 50 V) of the piezoelectric elements 102 for a period of time that does not cause any liquid to be ejected from the ejection ports 309 and applies the voltage to the piezoelectric elements 102 for a predetermined period of time (Step S01).

The purpose of applying a pre-drive voltage is to bring the state of polarization of each of the piezoelectric elements 102 into a state that easily allows the piezoelectric element 102 to be deformed. Therefore, the pre-drive voltage is higher than the highest voltage that is applied to the piezoelectric elements 102 in Step S03, which will be described hereinafter.

While the pre-drive voltage may vary as a function of the piezoelectric material for forming the piezoelectric elements 102, it is desirably a voltage that gives rise to an electric field similar to the electric field required at the time of polarization such as about 1 kV/mm.

The first power supply section 701 keeps on outputting the pre-drive voltage for a period of time that is sufficient for stabilizing the creep phenomenon (e.g., about 5 minutes) and then lowers it to the offset voltage level (Step S02). Additionally, the switch circuit 105 turns OFF the switches 702 that correspond to all the piezoelectric elements 102.

Thereafter, the first power supply section 701 outputs the drive voltage waveform of the piezoelectric elements 102 and the switch circuit 105 turns ON the one or more than one switches 702 that are connected to the one or more than one piezoelectric elements, the operation of driving which are to be controlled, according to the data that indicates the one or more than one piezoelectric elements to be driven. Then, as a result, the drive voltage is applied to the one or more than one piezoelectric elements 102 to be driven (Step S03) and liquid is ejected from the one or more than one ejection ports that correspond respectively to the one or more than one piezoelectric elements 102.

Then, as the operation of recording an image is over, the first power supply section 701 lowers the voltage to a predetermined voltage level (e.g., 0 V) (Step S04).

The pre-drive voltage needs to be applied for a period of time that makes the displacement amount of the piezoelectric element or each of the more than one of the piezoelectric elements not lower than a predetermined percentage (e.g., not lower than 80%, preferably not lower than 90) of the largest displacement amount of the piezoelectric element 102 that is produced due to a creep phenomenon. While the period of time during which the pre-drive voltage is applied varies as a function of the material of the piezoelectric elements 102, it should be not shorter than 1 minute. Preferably, the pre-drive voltage is applied for not shorter than 5 minutes in order to reliably obtain a desired result.

Generally, the state of polarization is degraded to a large extent when the piezoelectric elements 102 are left unused for a long period of time because the state of polarization changes with time. Therefore, the period of time for which the pre-drive voltage is to be applied needs to be modified accordingly. (For example, the pre-drive voltage may need to be applied for 1 minute if the piezoelectric elements are left unused for 3 days and the pre-drive voltage may need to be applied for 3 minutes if the piezoelectric elements are left unused for 1 week, whereas the pre-drive voltage may need to be applied for 5 minutes if the piezoelectric elements are left unused for 1 month). With such an arrangement, it is possible to reliable obtain a desired result and the time required for Step S01 can be reduced and any unnecessary waste of time can be avoided.

As an alternative arrangement, for example, the pre-drive voltage may be automatically applied once in several days as long as the piezoelectric elements are left unused. With such an arrangement, the polarization of the piezoelectric elements can be held in a state that is desirable for displacing the piezoelectric elements 102 with ease. Then, as a result, the liquid ejecting device can be started for operation within a reduced period of time.

The voltage is raised to the level of the pre-drive voltage (e.g., 70 V) for a period of time that does not cause any liquid to be ejected from the ejection ports in the description given above by referring to FIG. 10. However, the voltage may be raised for a longer period of time that causes liquid to be ejected from the ejection ports if the ejected liquid does not adversely affect the device and the recording medium.

The timing of applying the pre-drive voltage is desirably during the time period when the system and various stages are being initialized immediately after the start of operation of the drive circuit 700 (and hence the liquid ejecting device on which the drive circuit 700 is mounted) or at a time when the drive circuit 700 (and hence the liquid ejecting device on which the drive circuit 700 is mounted) has been at rest or has not been operated for not less than a predetermined period of time.

When the liquid ejecting device is preliminarily driven to eject liquid remaining around the ejection ports 309 to recover the proper operation of the device, the bias voltage may be raised while applying the ejection waveform.

Figure 11:
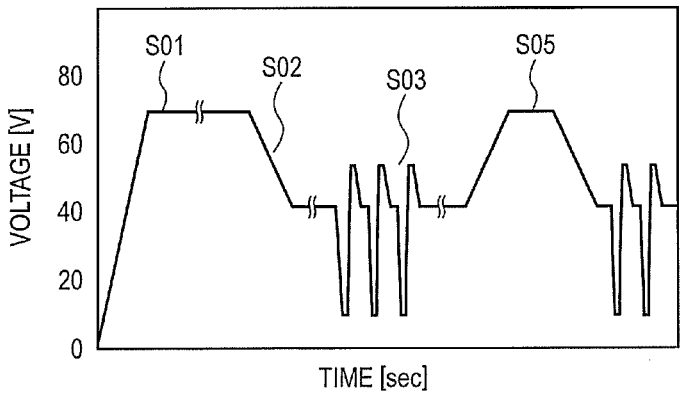
FIG. 11 is another exemplar waveform of the voltage to be applied to a piezoelectric element by a drive circuit.

FIG. 11 is another exemplar waveform of the voltage that can be applied to the piezoelectric elements from the first power supply section 701. Note that, in FIG. 11, the steps similar to those in FIG. 10 are denoted by the same reference symbols and will not be described here repeatedly.

When the operation of driving the piezoelectric elements 102 have been at rest for not less than a predetermined period of time after the end of Step S03 and the drive operation is restarted (to start recording an image), the first power supply section 701 applies the pre-drive voltage to the piezoelectric elements 102 immediately before starting to drive the piezoelectric elements 102 (Step S05).

The predetermined period of time as expressed herein is about several hours. Therefore, the period of time for which the pre-drive voltage is applied may be 1 minutes or less. With this arrangement, the polarization of the piezoelectric elements 102 can be held in a state that allows the piezoelectric elements 102 to be displaced with ease when the operation of recording an image is resumed after a long rest.

While the above description is given in terms of the voltage to be applied to the piezoelectric elements, a similar effect can be achieved so far as the direction of the electric field of the pre-drive voltage agrees with the direction of polarization of the piezoelectric elements 102.

Therefore, in the drive circuit 700*b* illustrated in FIG. 9, the electrode SIG of each of the piezoelectric elements 102 may be grounded and, at the same time, the first power supply section 701 may be connected to the electrode GND of each of the piezoelectric elements 102 by way of the corresponding switch 702 of the switch circuit 105 to apply a voltage representing a waveform obtained by turning the waveform illustrated in FIGS. 10 and 11 upside down in terms of positivity/negativity.

Still alternatively, the direction of polarization illustrated in FIG. 4 may be inverted and a voltage representing a waveform obtained by turning the waveform illustrated in FIGS. 10 and 11 upside down in terms of positivity/negativity may be applied.

As described above, the method of driving the piezoelectric elements 102 of this embodiment includes a step of applying a drive voltage waveform to drive the piezoelectric elements and a step of applying a pre-drive voltage to the piezoelectric elements prior to applying the drive voltage waveform, the pre-drive voltage being higher than the highest voltage of the drive voltage waveform.

Thus, the drive voltage waveform is applied after bringing the state of polarization of the piezoelectric elements 102 into a state where the piezoelectric elements 102 can be displaced with ease so that a large displacement amount can be obtained for each of the piezoelectric elements 102 and the robustness of the displacement amount of each of the piezoelectric elements can be improved.

Second Embodiment

Figure 12:
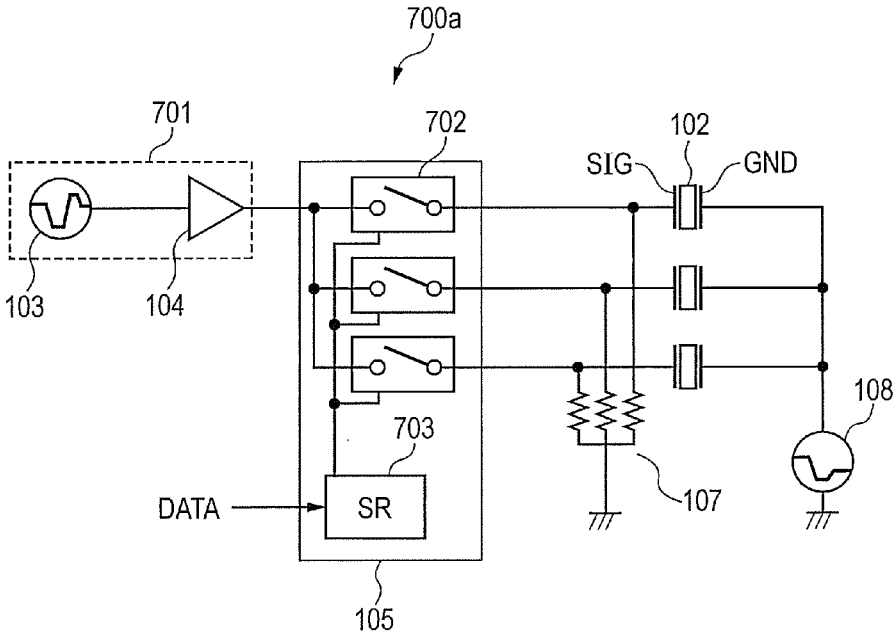
FIG. 12 is a schematic circuit diagram of the drive circuit according to the second embodiment of the present invention, representing the configuration thereof.

FIG. 12 is a schematic circuit diagram of the drive circuit 700*a* of the second embodiment of the present invention, representing the configuration thereof. Note that the components of the drive circuit of FIG. 12 that are similar to those of the drive circuit of FIG. 9 are denoted by the same reference symbols and will not be described here repeatedly.

The drive circuit 700*a* differs from the drive circuit 700 in that the pull-up resistors 106 of the drive circuit 700 are removed from the drive circuit 700*a* and pull-down resistors 107 and a waveform generating section 108 are added to the drive circuit 700*a* if compared with the drive circuit 700.

The pull-down resistors 107 are arranged upstream respectively relative to the electrodes SIG of the plurality of piezoelectric elements 102.

The waveform generating section 108 operates as the second power supply section and is connected to the electrodes GND of the plurality of piezoelectric elements 102 so that it can determine the voltage (bias voltage) to be applied to the electrode GND of each of the piezoelectric elements 102.

With the above-described configuration, as one or more than one of the switches 702 that correspond to one or more than one of the piezoelectric elements 102 are turned OFF, the bias voltage that is determined by the waveform generating section 108 is applied to the piezoelectric elements 102. On the other hand, as one or more than one of the switches 702 that correspond to one or more than one of the piezoelectric elements 102 are turned ON, a voltage that is equal to the difference between the output voltage of the first power supply section 701 and the output voltage (bias voltage) of the waveform generating section 108 is applied to the piezoelectric elements 102.

Figure 13A:
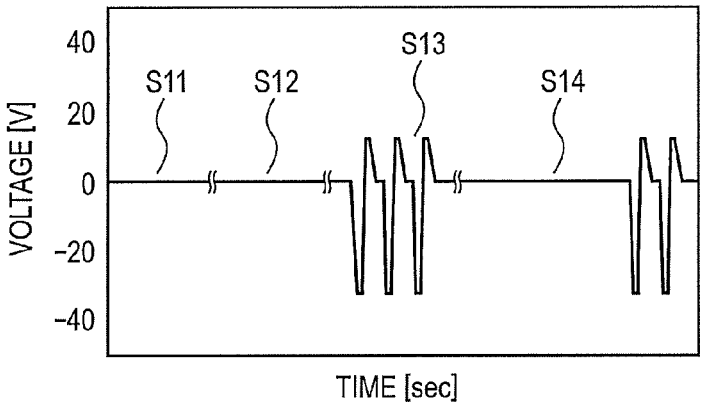
FIGS. 13A, 13B and 13C are exemplar waveforms of the voltages that can be applied respectively to a piezoelectric element and electrodes by the drive circuit illustrated in FIG. 12.
Figure 13B:
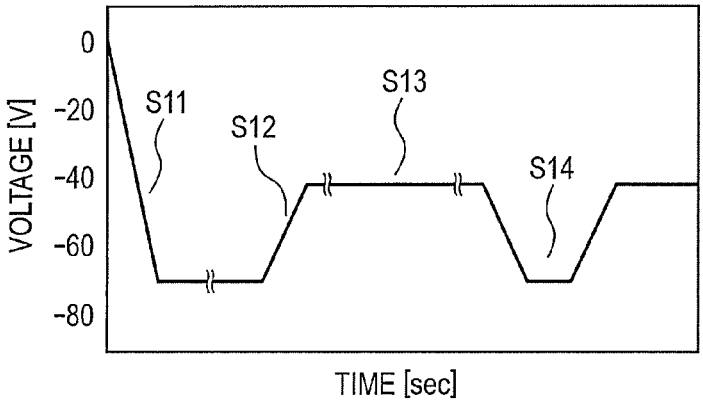
Figure 13C:
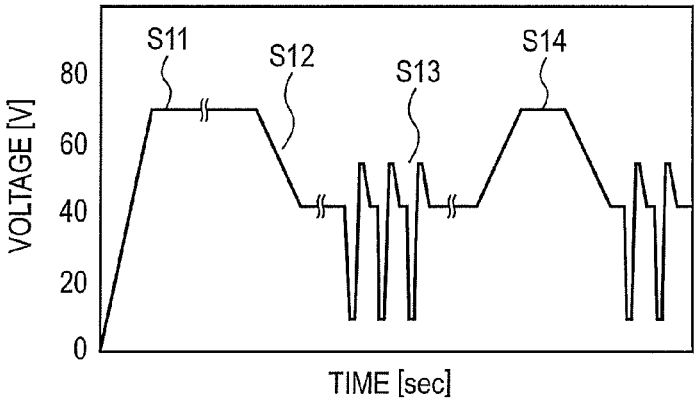

FIGS. 13A through 13C are exemplar waveforms of the voltages that can be applied to a piezoelectric element 102 and electrodes SIG and GDN. FIG. 13A is the waveform of the voltage that can be applied to electrode SIG and FIG. 13B is the waveform of the voltage that can be applied to electrode GND, whereas FIG. 13C is the waveform of the voltage that can be applied to a piezoelectric element 102.

In this embodiment, the power supply section 701 outputs only a drive voltage waveform, using 0 V as reference potential level.

Firstly, the waveform generating section 108 applies a negative voltage (−70 V) that corresponds to a pre-drive voltage to the electrode GND of each of the piezoelectric elements 102 (Step S11). In Step S11, the output voltage of the first power supply section 701 is 0 V as illustrated in FIG. 13A. Therefore, the pre-drive voltage (70 V) is applied to the piezoelectric elements 102 as illustrated in FIG. 13C.

The waveform generating section 108 keeps on outputting the negative voltage that corresponds to the pre-drive voltage for a period of time sufficient for allowing the creep phenomenon to be stabilized (e.g., about 5 minutes) and subsequently rises the voltage to a negative voltage level (−40 V) that corresponds to the offset voltage (Step S12). In Step S12, the output voltage of the first power supply section 701 is also 0 V as illustrated in FIG. 13A. Therefore, the offset voltage (40 V) is applied to the piezoelectric elements 102 as illustrated in FIG. 13C.

Then, the first power supply section 701 outputs a drive voltage waveform, using 0 V as reference potential level as illustrated in FIG. 13A (Step S13). The waveform generating section 108 keeps on outputting the output voltage of Step S12 as illustrated in FIG. 13B. Therefore, a voltage obtained by adding the output voltage of the first power supply section 701 to the offset voltage is applied to the piezoelectric elements 102 as illustrated in FIG. 13C.

Then, after ending the operation of Step S13, if the operation of driving the piezoelectric elements 102 is suspended for a predetermined period of time and subsequently the piezoelectric elements are driven to operate (to start recording an image), the waveform generating section 108 outputs a negative voltage (−70 V) that corresponds to the pre-drive voltage immediate before starting to drive the piezoelectric elements 102 as illustrated in FIG. 13B. Since the output voltage of the first power supply section 701 is 0 V as illustrated in FIG. 13A, the pre-drive voltage (70 V) is applied to the piezoelectric elements 13C as illustrated in FIG. 13C.

Thus, with this embodiment, a pre-drive voltage is applied to the piezoelectric elements without employing the switch circuit 105.

Therefore, only a low voltage (a voltage that does not exceed ±40 V in FIG. 13A) is applied to the switch circuit 105 and hence there is not any need of using a member that withstands a high voltage for the switch circuit 105 so that the cost of the switch circuit 105 can be reduced.

While the present invention has been described with reference to exemplary embodiments, it is to be understood the invention is not limited to the disclosed exemplary embodiments. The scope of the following claims is to be accorded the broadest interpretation so as to encompass all such modification and equivalent structures and functions.

This application claims the benefit of Japanese Patent Application No. 2013-002410, filed Jan. 10, 2013, which is hereby incorporated by reference herein in its entirety.

What is claimed is:

1. A piezoelectric element drive method of applying drive voltage waveforms to a plurality of piezoelectric elements to deform the piezoelectric elements, the method comprising:

a step of applying pre-drive voltages to the piezoelectric elements prior to applying said drive voltage waveforms; and a step of applying the drive voltage waveforms to the piezoelectric elements using a drive circuit so as to drive the piezoelectric elements, wherein the pre-drive voltage of a piezoelectric element has a higher voltage than a highest voltage of the drive voltage waveform, and said drive circuit comprises (i) a first power supply section that outputs the drive voltage waveform, (ii) a switch circuit that selectively applies the drive voltage waveform output from the first power supply section to first electrodes of the plurality of piezoelectric elements, and (iii) a second power supply section that applies a voltage to respective second electrodes of the plurality of piezoelectric elements and outputs a bias voltage after the output of the pre-drive voltage.

2. The method according to claim 1, wherein the drive circuit applies the pre-drive voltage immediately after the start of operation of the drive circuit or immediately after the start of operation of the drive circuit that has been at rest or has not been driven for not less than a predetermined period of time.

3. The method according to claim 2, wherein the drive circuit applies the pre-drive voltage for at least 1 minute after the start of operation of the drive circuit.

4. The method according to claim 2, wherein the drive circuit keeps on applying the pre-drive voltage until a displacement amount of the piezoelectric element gets to at least 80% of a largest possible displacement amount of the piezoelectric element immediately after the start of operation of the drive circuit.

5. The method according to claim 1, wherein the direction of polarization of the piezoelectric element agrees with the direction of electric field of the pre-drive voltage.

6. The method according to claim 1, further comprising: a step of applying a predetermined voltage to the piezoelectric element after applying the pre-drive voltage to the piezoelectric element to drive the piezoelectric element.

7. A liquid ejecting device for ejecting liquid from a plurality of liquid chambers having a wall formed by a piezoelectric element to record an image by applying a drive voltage waveform to said piezoelectric element thereby deforming the piezoelectric element, the device comprising:

a drive circuit that applies a pre-drive voltage to the piezoelectric element prior to applying said drive voltage waveform to the piezoelectric element, the pre-drive voltage having a higher voltage than a highest voltage of the drive voltage waveform;

said drive circuit comprising (i) a first power supply section that outputs the drive voltage waveform, (ii) a switch circuit that selectively applies the drive voltage waveform output from the first power supply section to first electrodes of the plurality of piezoelectric elements, and (iii) a second power supply section that applies a voltage to respective second electrodes of the plurality of piezoelectric elements and outputs a bias voltage after the output of the pre-drive voltage.

8. The device according to claim 7, wherein the drive circuit applies the pre-drive voltage immediately after the start of operation of the liquid ejecting device or immediately after the start of operation of the liquid ejecting device that has been at rest or has not been driven for not less than a predetermined period of time.

9. The device according to claim 8, wherein the drive circuit applies the pre-drive voltage for at least 1 minute after the start of operation of the liquid ejecting device.

10. The device according to claim 8, wherein the drive circuit keeps on applying the pre-drive voltage until a displace amount of the piezoelectric element gets to at least 80% of a largest possible displacement amount of the piezoelectric element immediately after the start of operation of the liquid ejecting device.

11. The device according to claim 7, wherein the direction of polarization of the piezoelectric element agrees with the direction of electric field of the pre-drive voltage.

12. The device according to claim 7, wherein the drive circuit applies a predetermined voltage to the piezoelectric element after applying the pre-drive voltage to the piezoelectric element to drive the piezoelectric element.

* * * * *